United States Patent [19]

Alex

[11] Patent Number: 5,053,750

[45] Date of Patent: Oct. 1, 1991

[54] WALLET GUARD

[76] Inventor: Leonard Alex, 55 Ridge Rd., Roseland, N.J. 07068

[21] Appl. No.: 538,567

[22] Filed: Jun. 15, 1990

[51] Int. Cl.[5] ..... G08B 13/14; H01H 27/04

[52] U.S. Cl. ..... 340/568; 200/61.19

[58] Field of Search ..... 340/568; 200/61.19, 200/61.59, 506; 160/351

[56] References Cited

U.S. PATENT DOCUMENTS

| | | | |
|---|---|---|---|
| 3,530,451 | 1/1967 | Devine | 340/572 X |
| 3,930,249 | 12/1975 | Steck et al. | 340/571 |
| 3,959,789 | 5/1976 | McGahee | 340/568 X |
| 4,090,183 | 5/1978 | Miller | 340/571 |
| 4,480,250 | 10/1984 | McNeely | 340/568 |
| 4,584,571 | 4/1986 | Smit et al. | 340/568 X |
| 4,652,865 | 3/1987 | Maharshak | 340/568 |
| 4,717,908 | 1/1988 | Phillips et al. | 340/568 |
| 4,780,704 | 10/1988 | Tommasini | 340/568 X |
| 4,884,062 | 11/1989 | Lin et al. | 340/568 X |
| 4,890,094 | 12/1989 | Kopel | 340/568 X |

*Primary Examiner*—Glen R. Swann, III
*Assistant Examiner*—Thomas J. Mullen, Jr.
*Attorney, Agent, or Firm*—Thomas L. Adams

[57] ABSTRACT

A guard for a wallet or other item has a foldable panel with an inside and an outside. The panel is sized to encompass the wallet. The guard has a pair of exposed contacts mounted at opposite ends of the inside of the panel. An audible alarm in the guard is mounted on the panel and is serially connected to the contacts. Also included is a battery holder mounted on the panel and serially connected with the alarm and the contacts. The panel can fold about the wallet. Thus, the contacts are open unless the wallet is removed.

17 Claims, 2 Drawing Sheets

FIG. 1
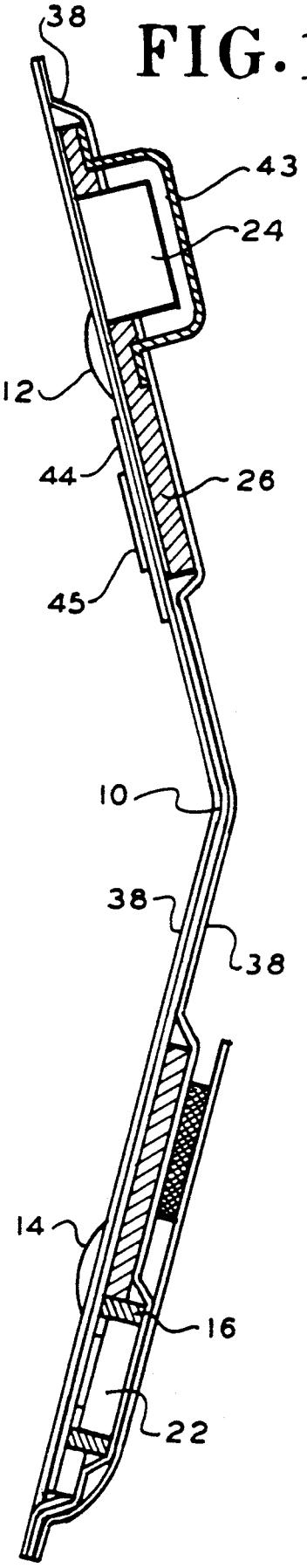
FIG. 5
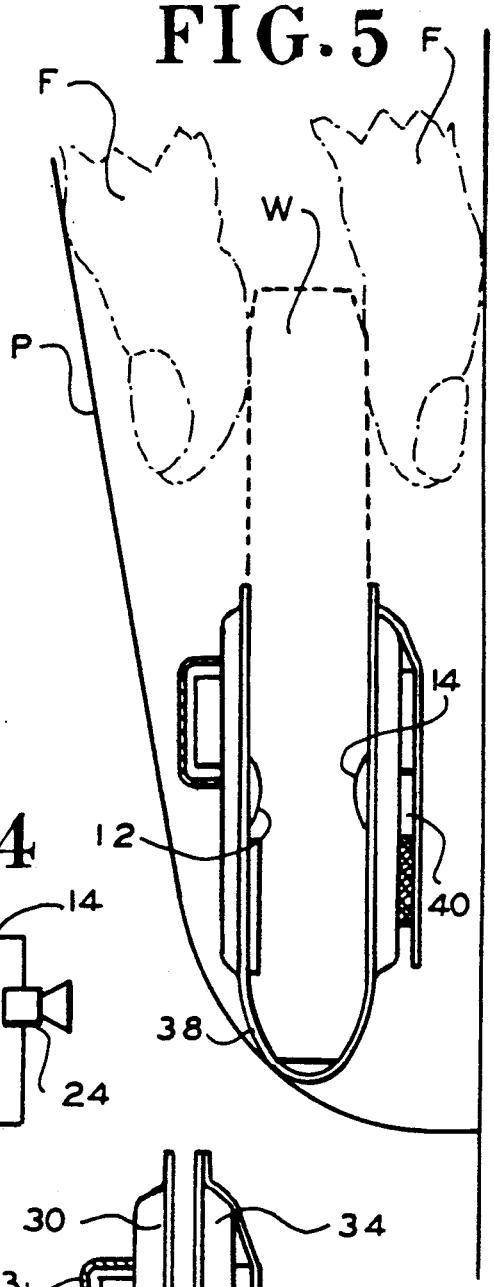
FIG. 4
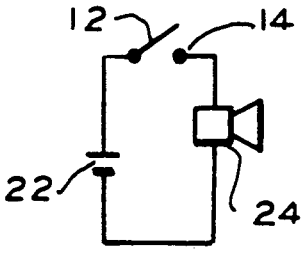
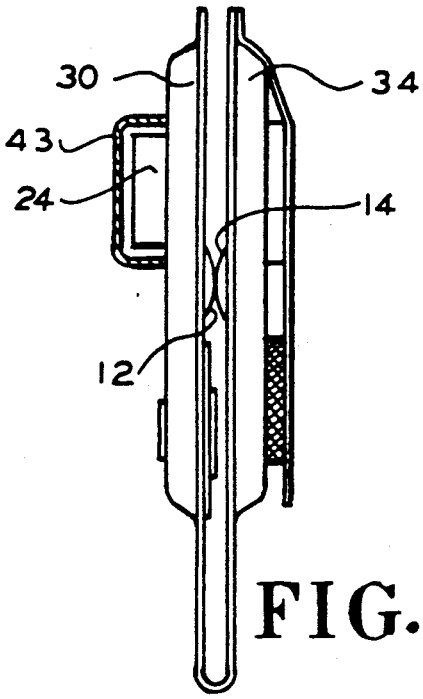
FIG. 6

WALLET GUARD

BACKGROUND OF THE INVENTION

The present invention relates to a wallet guard for defeating a pickpocket, and, in particular, to a foldable panel having contacts to detect the removal of a wallet.

Thefts by pickpockets cause substantial economic losses. A skilled pickpocket can remove an unguarded wallet without alarming the average person. Known sensors (e.g., U.S. Pat. No. 4,090,183) employ a clip that is secured to a wallet. The clip is connected to a plate and all are placed together in a pocket with a wallet. An unauthorized removal of the wallet takes the clip away from the plate, which activates an electrical circuit and sounds an alarm. A disadvantage with this type of alarm is the inconvenience of handling multiple parts that must be carefully loaded together in a pocket.

Also known is a magnetic detector that fits inside a pocket. A magnet fits in a guarded wallet next to the magnetic detector in the pocket. Unauthorized removal of the magnetic wallet is sensed by the magnetic detector to sound an alarm. A disadvantage of a sensor of this type is the need to keep the sensor very close to the magnet inside the wallet. Otherwise, the magnetic sensor must be impractically sensitive.

It is also known (U.S. Pat. No. 4,884,062) to include a pair of electrical contacts in a folding wallet. Squeezing pressure by a pickpocket brings these contacts together to sound an alarm. A disadvantage with this wallet guard is the need to include complicated and bulky items in a wallet. Furthermore, pressure caused by sitting can trigger this device.

It is also known to provide a credit card holder having a series of pockets with internal electrical contacts. An inserted credit card can separate the contacts and disable the alarm. The purpose of these credit card holders is primarily to remind the cardholder to return each credit card to its designated pocket so it is not misplaced during a purchase.

Accordingly, there is a need for a simple, improved device for reliably sounding an alarm when a wallet is picked from a pocket.

SUMMARY OF THE INVENTION

In accordance with the illustrative embodiments demonstrating features and advantages of the present invention, there is provided a guard for a wallet or other item. The guard has a foldable panel with an inside and an outside and sized to encompass the wallet. The guard includes a pair of opposed contacts mounted at opposite ends of the inside of the panel. Also, included is an audible alarm mounted on the panel and serially connected to the contacts. The guard has a battery holder mounted on the panel and serially connected with the alarm and the contacts. The panel can fold about the wallet. Thus, the contacts are open unless the wallet is removed.

By employing apparatus of the foregoing type, an improved wallet guard is provided. In the preferred embodiment, a foldable panel supports two pairs of magnets on either end of the panel. The magnets can hold the panel closed in a folded position. A pair of electrical contacts are mounted on the panel facing inwardly so that when the magnets hold the panel folded, the electrical contacts close.

These electrical contacts are serially connected with a piezo-electric alarm and a battery in a battery holder.

Thus, when the panel is partially folded, the magnets draw the contacts together and sound an alarm.

In a preferred embodiment, the panel includes flexible printed circuit board, which is sandwiched between the inside and outside layers of a sheath. This provides both a substrate for mounting the battery holder, alarm and electrical contacts, but also provides a foldable panel that permits the folding.

Preferably, the assembly is sheathed in plastic with a flap to expose the battery holder. Also, in a preferred embodiment, a plastic shutter can swivel in front of one of the contacts to preclude an alarm when the wallet guard in not in use.

BRIEF DESCRIPTION OF THE DRAWINGS

The above brief description as well as other objects, features and advantages of the present invention will be more fully appreciated by reference to the following detailed description of presently preferred, but nonetheless illustrative embodiments in accordance with the present invention when taken in conjunction with the accompanying drawings wherein:

FIG. 1 is an edge view, partially in section, of a guard in accordance with the principles of the present invention;

FIG. 4 is a schematic diagram associated with the circuitry of the guard of FIG. 1.

FIG. 5 is an edge view of the guard of FIG. 1 folded around a wallet; and FIG. 6 shows the guard of FIG. 1 collapsed to sound the alarm.

DETAILED DESCRIPTION OF THE PREFERRED EMBODIMENTS

Figure 2:
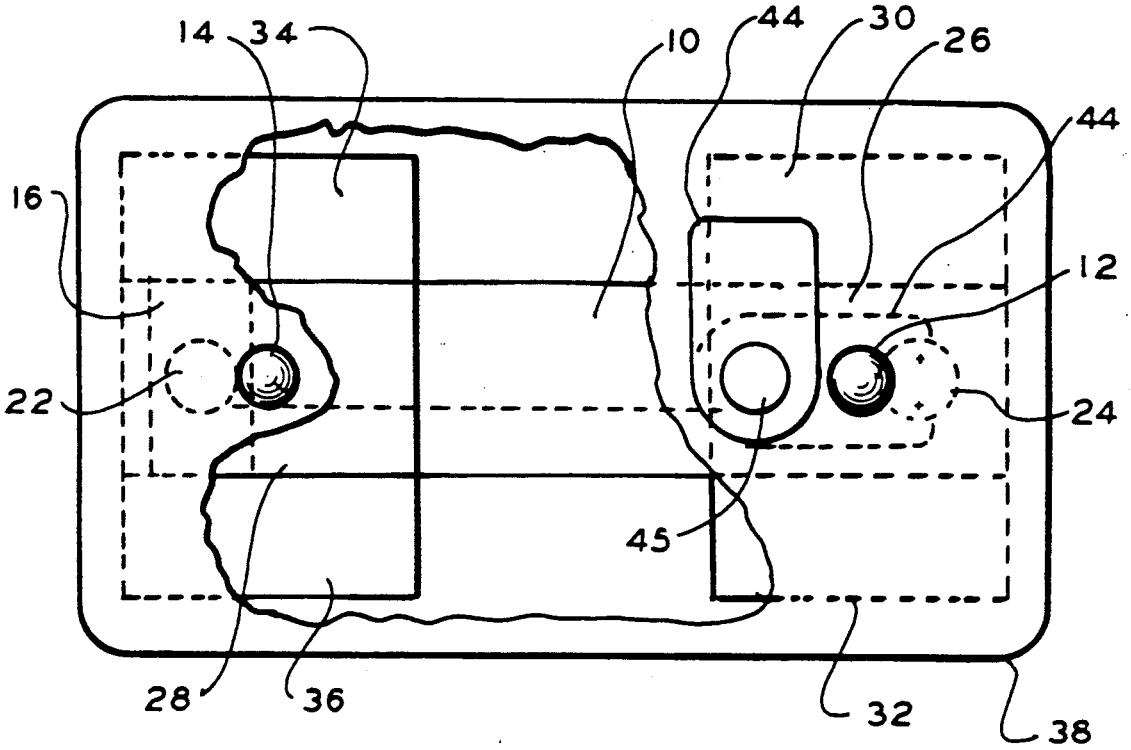
FIG. 2 is an inside plan view of the guard of FIG. 1.
Figure 3:
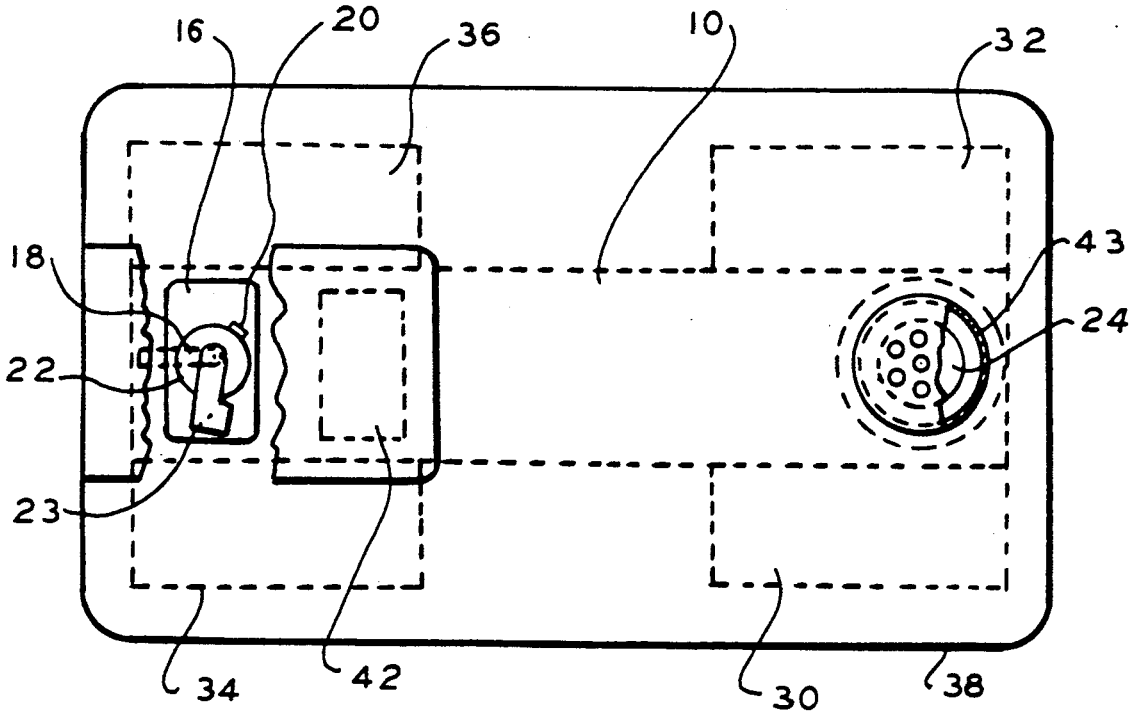
FIG. 3 is an outside plan view of the guard of FIG. 1.

Referring to FIGS. 1, 2, and 3 a wallet guard is shown employing a foldable panel 10 in the form of a flexible printed circuit board. A pair of electrical contacts 12 and 14 are soldered in the usual fashion to flexible circuit board 10. Contacts 12 and 14 are copper, nail-like structures, although other materials and shapes can be employed in different embodiments. The exposed area of contacts 12 and 14 are positioned and sized to provide a high probability of electrical contact when flexible circuit board 10 is folded.

A battery holder 16 in the form of a rectangular block has a cylindrical recess to hold a 1.5 Volt battery of the type commonly used in wristwatches (e.g., battery type 386). Holder 16 has a pair of spring contacts 18 and 20 which are beneath the battery and are soldered to flexible board 10 for touching the negative and positive faces respectively of battery 22. Outside arm 23 can be swiveled away to allow removal of battery 22. Audible alarm 24 is soldered at the end of board 10 opposite battery holder 16. Alarm 24 can be a piezoelectric crystal driven by internal circuitry that can be powered by a direct current voltage.

The electrical connections accomplished by printed circuit board 10 are illustrated in FIG. 4, which shows battery 22 and alarm 24 serially connected with contacts 12 and 14. It will be appreciated, however, that in some embodiments panel 10 can be eliminated and wires of various types can connect the contacts, battery and alarm.

Plastic rectangular plate 26 has a central hole through which alarm 24 is inserted. Plate 26 is located on the outside of, and is about the same width as, printed circuit board 10. Similarly, plastic plate 28 has the same width and thickness as plate 26 and butts up against battery holder 16.

As shown in FIG. 2, plate 26 is between and parallel to magnets 30 and 32. Similarly, plate 28 is between and parallel to magnets 34 and 36. Magnets are flat rectangular prisms referred to as closure means. Plates 26 and 28 ensure that when magnets 30 and 32 are attracting magnets 34 and 36, plates 26 and 28 are urged together to close contacts 12 and 14.

Sheath 38 envelops panel 10 in this embodiment. Sheath 38 is preferably formed from two rectangular vinyl sheets that are heat sealed along all four edges. In this embodiment, sheath 38 has an opening to allow access to battery holder 16. Vinyl door flap 40 covers the access opening for holder 16. Flap 40 is held closed by a securing means in the form of a Velcro (TM) strip 42. Audible alarm 24 is encompassed and protected by a perforated guard 43 in the form of a flanged cup made of high impact plastic. Guard 43 has its flange mounted under sheath 38.

Insulating shutter 44 is rotatably attached to plate 26 by rivet 45. Shutter 44 is shown in FIG. 2 in a retracted position to expose contact 12. Insulating shutter 44 is shown in phantom rotated 90° to cover contact 12.

To facilitate an understanding of the principles associated with the foregoing apparatus, its operation will be briefly described in connection with FIGS. 5 and 6. In FIG. 5, wallet W is shown in pocket P with the apparatus of FIG. 1 folded around the wallet. In some cases wallet W may be replaced by cash or by another receptacle such as a purse or money clip and the apparatus of FIG. 1 can be pinned inside a woman's purse or secured to a night table, bed sheet or other location where the guarded receptacle is kept. In the illustrated embodiment, sheath 38 is folded in half with contacts 12 and 14 facing each, but separated by wallet W. As illustrated, a pickpocket may insert his fingers F into pocket P to remove wallet W. When wallet W is removed, the four magnets (magnets 30–36 of FIG. 2) are drawn together. Since there are four spaced magnets, the magnets will align themselves to bring contacts 12 and 14 against each other. The plates (plates 26 and 28 of FIG. 2) cooperating with sheath 38, ensure that the magnets apply force against contacts 12 and 14. Consequently, contacts 12 and 14 are brought firmly together to close the circuit illustrated in FIG. 4. Accordingly, a 1.5 Volt potential is applied to alarm 24 to sound the alarm. This alarm alerts the owner to the work of the pickpocket.

It is to be appreciated that various modifications may be implemented with respect to the above described preferred embodiments. For examples, the dimensions of the guard can be altered depending upon the size of the wallet to be protected. Furthermore, the battery and alarm may in some embodiments be placed on the same end of the printed circuit board. Also, the contacts can be moved closer or further away from the end of the guard. Additionally, various types of alarms can be used depending upon the desired intensity of the sound or if a visual or other type of signal is to be given. While plastic materials are illustrated, other materials including leather can be used in some embodiments. Also, the pocket guard can be made relatively inflexible except at the center where it folds, by employing stiffeners or a circuit board that is relatively thick at the location where the electrical components are mounted. In this connection, two rigid circuit boards can be located at opposite ends of the guard and connected by wires, metal bands, etc.

Obviously many modifications and variations of the present invention are possible in light of the above teachings. It is therefore to be understood that within the scope of the appended claims, the invention may be practiced otherwise than as specifically described.

What is claimed is:

1. A guard for a wallet having a thickness that lies within a predetermined range, comprising:

a foldable panel having an inside and an outside and sized to encompass said wallet and sized to accompany it, said foldable panel being operable to fold through substantially 180°, said panel having a midsection with a non-zero area that is operable to fold about said wallet at any wallet thickness within said predetermined range;

a pair of exposed contacts mounted at opposite ends of the inside of said panel;

an alarm mounted on said panel and serially connected to said contacts; and a battery holder mounted on said panel and serially connected with said alarm and said contacts, said panel being foldable about said wallet, so that said contacts are open unless said wallet is removed.

2. A guard according to claim 1 further comprising:

a pair of plates separately mounted behind each of said contacts to support and project them inwardly.

3. A guard according to claim 1 further comprising:

closure means for urging said panel into a folded condition to close said contacts.

4. A guard according to claim 3 further comprising:

an insulating shutter pivotally mounted parallel to said panel to swing over one of said contacts to prevent it from closing.

5. A guard according to claim 3 wherein said closure means comprises:

a pair of magnets, each being mounted alongside a different corresponding one of said pair of contacts to urge them together.

6. A guard according to claim 3 wherein said closure means comprises:

two pairs of magnets, each pair of said magnets straddling a different corresponding one of said contacts to urge them together.

7. A guard according to claim 6 wherein said panel comprises:

a circuit section; and a sheath enveloping said circuit section.

8. A guard according to claim 7 wherein said circuit section comprises:

a flexible printed circuit board having connections for said battery holder, said alarm and said pair of contacts, said flexible printed circuit board being flexible throughout said midsection.

9. A guard according to claim 8 wherein said alarm and said battery holder are mounted at opposite ends of the outside of said panel.

10. A guard according to claim 8 further comprising:

a pair of magnets, each being mounted alongside a different corresponding one of said pair of contacts to urge them together.

11. A guard according to claim 8 further comprising:

two pairs of magnets, each pair of said magnets straddling a different corresponding one of said pair of contacts to urge them together.

12. A guard according to claim 11 wherein said alarm and said battery holder are mounted at opposite ends of the outside of said panel.

13. A guard according to claim 12 further comprising:

a pair of plates separately mounted behind each of said contacts to support and project them inwardly.

14. A guard according to claim 13 wherein said panel comprises:

a circuit section; and a sheath enveloping said panel.

15. A guard according to claim 14 wherein said sheath includes:

a door flap over said battery holder; and securing means for releasably holding said door flap closed.

16. A guard according to claim 15 further comprising:

an insulating shutter pivotally mounted parallel to said panel to swing over one of said contacts to prevent it from closing.

17. A guard according to claim 15 further comprising:

a perforated, cup-shaped guard encompassing and protecting said alarm.

* * * * *